US005183963A

United States Patent [19]

Beaufils et al.

[11] Patent Number: 5,183,963

[45] Date of Patent: Feb. 2, 1993

[54] TWO PIECE PROJECTILE

[76] Inventors: Stephen C. Beaufils, 14 Endeavour Road, George's Hall, Australia, 2198; Alfonso Latella, 69 Ely Street, Revesby, Australia, 2212

[21] Appl. No.: 789,982

[22] Filed: Nov. 12, 1991

[30] Foreign Application Priority Data

Nov. 13, 1990 [AU] Australia ..... PK3332

[51] Int. Cl.[5] ..... F42B 14/00

[52] U.S. Cl. ..... 102/515; 102/501; 102/517

[58] Field of Search ..... 102/501, 514, 515, 516, 102/517, 518, 519

[56] References Cited

U.S. PATENT DOCUMENTS 4,251,079 2/1981 Earl et al. ..... 102/501
4,301,733 11/1981 Blanco ..... 102/517
4,365,559 12/1982 Gruaz ..... 102/501
5,038,684 8/1991 Petrovich ..... 102/515

*Primary Examiner*—Charles T. Jordan
*Attorney, Agent, or Firm*—Jacobson, Price, Holman & Stern

[57] ABSTRACT

A two part projectile having a nose piece or slug (1) and a tail piece or jacket (6). The slug (1) is lead alloy and includes a cylindrical shank (3) at its trailing end. The jacket (6) has a cylindrical bore which fits over, and is permanently attached to, the shank (3). The jacket (6) is of plastics material which insulates the lead slug (1) from the heat of the burning propellent and slides easily along the bore of the gun without leaving deposits. The jacket (6) remains fixed to the slug (1) during the entire flight of the projectile.

10 Claims, 2 Drawing Sheets

TWO PIECE PROJECTILE

INTRODUCTION

The present invention relates to projectiles to be fired from barrels of firearms. It especially relates to home cast lead projectiles for use in side arms.

BACKGROUND

Projectiles fired from the barrel of guns are propelled by a highly pressured gas discharge produced from the burning of a propellent. While the projectile must be free enough in the barrel to be accelerated to a maximum velocity, it must effectively form a gas seal with the bore so as to extract the maximum available energy from the expanding gas. Most commonly the bore includes rifling to spin the projectile and the rifling may tend to strip off some amount of lead from the projectile as it heats and travels along the barrel at very high velocity.

It is popular for firearms or small arm owners to home cast projectiles using a two stage process. Firstly, a nominally sized lead slug is cast. Secondly the slug is pressed through an accurately sized die and a copper seal is simultaneously press fitted to its base. The finished projectile normally includes annular driving bands and, intermediate the driving bands, wax grooves. The wax is forced into the grooves during the pressing operation and, when fired, reduces leading of the barrel.

OBJECT OF THE INVENTION

It is an object of the invention to provide a high performance projectile which is inexpensive and can be easily produced at home.

It is another object of the invention to provide a projectile making highly efficient use of propellant gas pressure.

SUMMARY OF THE INVENTION

The present invention in essence provides, in part, a slug of particular shape, and in part, a plastic jacket, which two parts can be assembled to form a projectile which will be fired with the plastic jacket forming the rear section of the projectile.

Accordingly, in one broad form, the invention may be said to provide a projectile comprising:

a slug having a nose section at one end and a shank section at an opposite end;

a jacket, of plastics material, being a generally hollow cylinder with a closed base encasing the shank section of the slug and sized so as to correspond to a preselected nominal gun bore; and fixing means securing the slug and jacket combination together sufficiently strongly to maintain the combination together during firing and subsequent flight of the projectile.

The invention, in another form, provides a kit of parts being:

a slug having a nose section at one end and a shank section at an opposite end; and a jacket, of different material to that of the slug, being a generally hollow cylinder with a closed base and being dimensioned such that the shank section can be inserted into the hollow of the jacket and secured therein by a fixing means so as to form the above described projectile with the outer dimension of the jacket sized so as to correspond to a preselected nominal gun bore.

The invention further provides a jacket being a generally hollow cylinder with a closed base, having an internal diameter, of the hollow, such that it can be secured over a shank section of a complementary slug so as to form the above described projectile with an outer diameter corresponding to a preselected gun bore.

The invention also provides a slug having a nose section at one end and a smaller diameter shank section at an opposite end such that the shank section can be inserted into a complementary jacket and fixedly secured therein, so as to form a projectile as described above. Further provided by the invention is a mould for producing such a slug from a castable material, such as lead.

Preferably the slug is of lead or lead alloy but may be of an alternative suitable high density material.

Preferably the fixing means is selected from one, or a combination, of; adhesive, an interference fit, or a mechanical interlock, between the jacket and the shank.

DESCRIPTION OF THE DRAWINGS

By way of example only, preferred embodiments of the invention will now be described with reference to the drawings FIG. 1, which shows a sectional side view of a projectile according to the invention before its final assembly.

BEST MODE OF CARRYING OUT THE INVENTION

Figure 1:
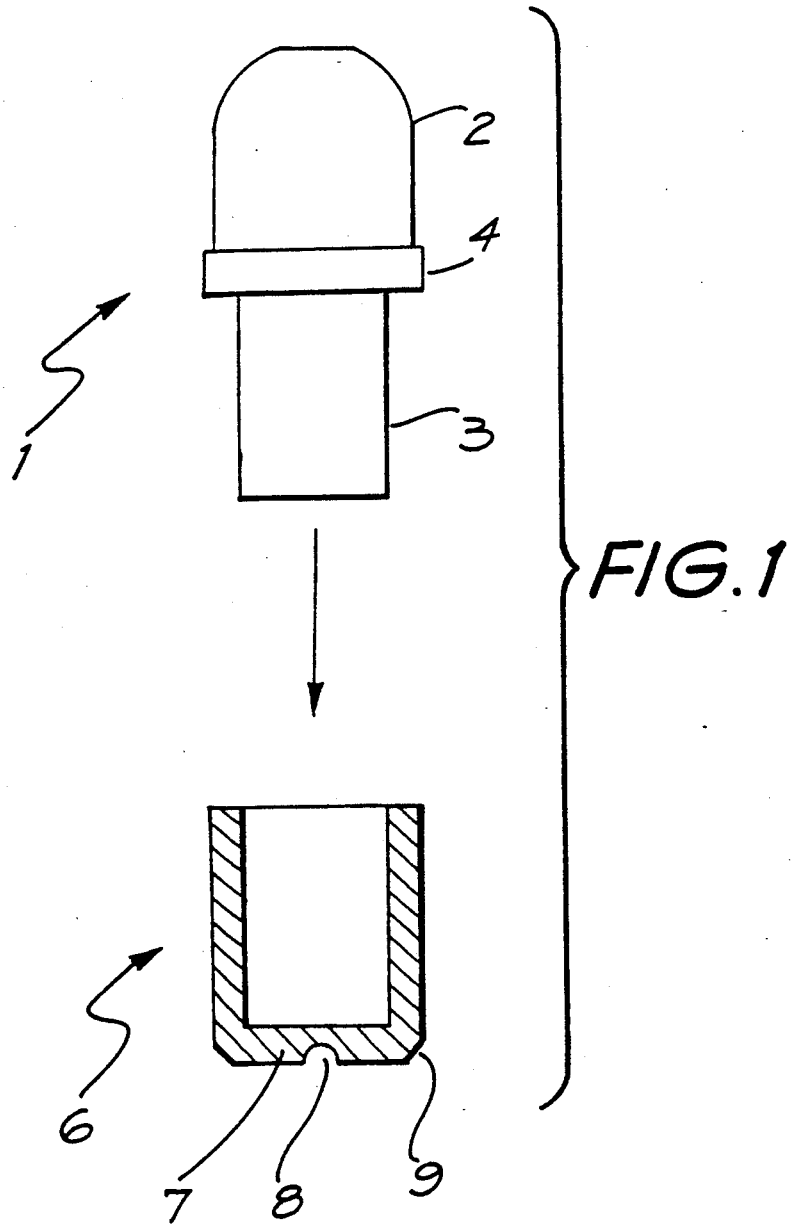

The projectile comprises a cast lead slug 1 and a thermo-plastic hollow jacket 6. The rear of the slug 1 includes a shank section 3 sized to be closely inserted with an interference fit within the hollow interior of jacket 6. The assembly of the slug 1 and jacket 6 is secured together by a suitable adhesive, such as an epoxy resin adhesive, inserted into the jacket 6 before assembly.

The slug 1 includes a nose section 2 which is shaped as desired taking into account the intended use of the projectile.

Between the nose 2 and the shank 3 the slug 1 includes a diametrically raised annular driving band 4. The band 4 defines the maximum diameter of the projectile and drives the projectile rotatably about its central axis as it is fired out the barrel of a rifled gun. As with conventional projectiles, the driving band 4 is not an essential component.

The jacket 6 includes a base section 7 which forms the gas seal against the bore of the gun during firing. The perimeter of the base 7 includes a chamfer 9 which is accurately shaped so that at the point of exit of the projectile from the barrel there is a uniform escape of the pressured gas driving the projectile about its whole circumference. Any non-uniform escape of gas at this point of time may result in a less than perfect flight of the projectile.

The outer diameter of the jacket 6, once the projectile is assembled, corresponds to the bore of the gun from which the projectile is intended to be fired. The exact diametric size, measured in the order of 100ths of a mm., will be determined by the exact bore of the gun, the intended use for the projectile, and the personal choice of the user or manufacturer.

The jacket 6 can be moulded to very precise dimensions in a range of finely spaced actual sizes about any nominal bore size. Further, the actual diametric size of the jacket 6 will be altered on assembly of the projectile as there is an interference fit with the shank 3.

As there is an interference fit between the inside of the jacket 6 and the shank 3, it may in some cases be acceptable to omit the securing adhesive.

When the jacket 6 is produced by a moulding process the indent 8 may be formed by the sprue ejecting the jacket from the mould.

When the projectile is fired the nose 2 and driving band 4 fit within the bore in the conventional sense, the driving band 4 being cut by the rifling and spinning the projectile as it is accelerated along the barrel. The base 7 of the plastic jacket 6 forms the gas seal between the projectile and the bore so that the expanding propellent gas behind the projectile cannot escape until the projectile has left the barrel. The jacket 6 also has important, rifling gripping (ie rotating) qualities equal at least to that of the nose and driving band.

The jacket 6, being of a plastics material, insulates the lead of the slug 1 from the heat of the burning propellant and allows a larger propellant charge to be packed. Higher gas pressures and muzzle velocities are thus obtainable. The long cylindrical side of jacket 6 provides a good bearing surface for the projectile as it moves up the barrel, thus maintaining it accurately aligned as it is spun and accelerated up to the end of the barrel. Once in free flight the long length and smooth outer wall of the jacket 6 adds to the stability by aerodynamic effects.

Figure 2:
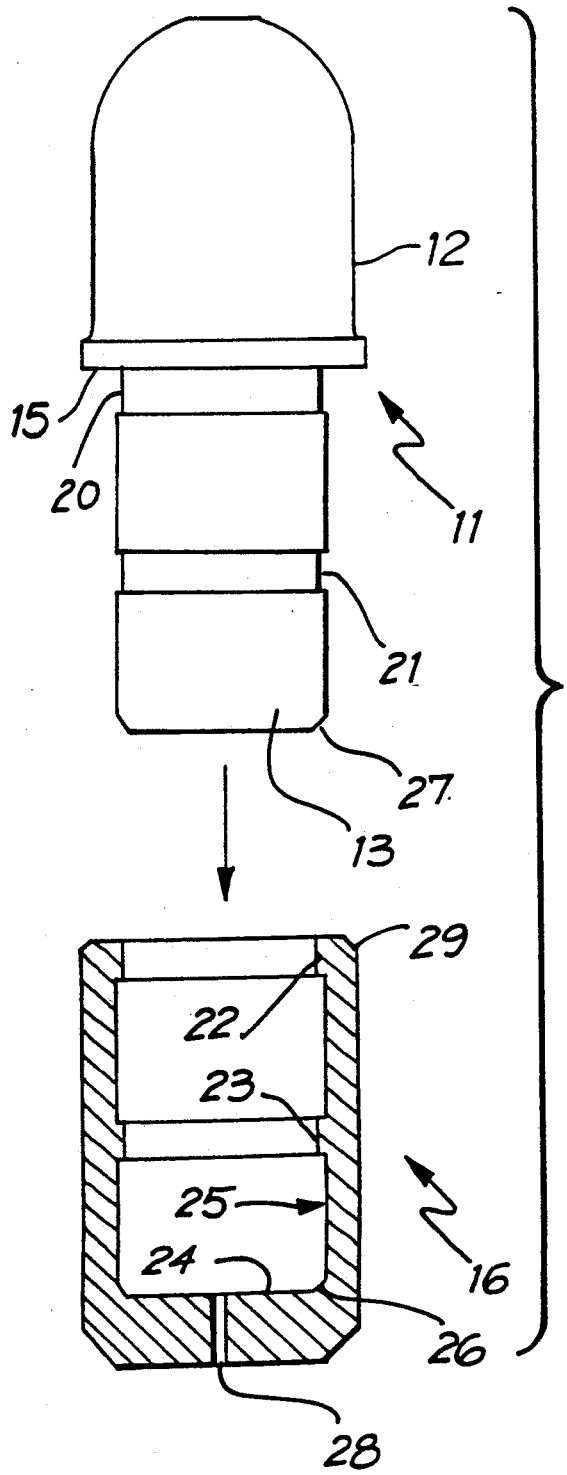
FIG. 2, which shows an alternative embodiment.

The slug 11 of FIG. 2 includes two grooves 20 and 21, each extending around the shank 13. The grooves 20 and 21 correspond in size and location to respective annular lugs 22 and 23 inside the jacket 16. The resiliency of the plastic jacket 16 allows it to be pressed over the shank 13 and into the assembled position with the lugs 22 and 23 residing in the respective grooves 20 and 21. The lugs 22 and 23 engage the grooves 20 and 21 to maintain the assembled projectile in one piece during firing and flight.

There is an interference fit between the remaining portions of the shank 13 and the inside of the jacket 16.

The inside closed end 24 of the jacket 16 includes a radiused or chamfered join 26 with the inside cylindrical surface 25. This increases the strength of the jacket 16 which is subjected to large pressures when fired. A corresponding chamfer 27 is formed in the shank 13 so that the end 24 of the jacket 16 may push up squarely against the end of the shank 13.

Also in the closed end 24 is a small axial passage 28 which allows air to escape from between the inside of the jacket 16 and the shank 13 while the two parts are being assembled in the case where adhesive is used.

An additional chamfer 29 around the outer leading edge of the jacket 16 spaces the outer leading edge 15 of the jacket 16 from the rear face of the nose Section 12 and is intended to reduce air drag on the jacket 16.

Figure 3:
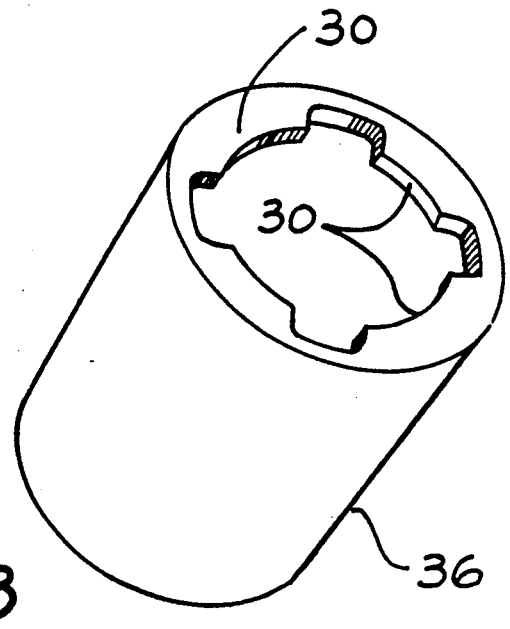
FIG. 3, which shows a further alternative embodiment in perspective.

FIG. 3 shows a jacket 36 including lugs 30 which are segmented and extend about the inside opening. These lugs 30 engage a groove which may be similar to the groove 20 shown in FIG. 2. The profile of the lugs 30 can be varied but should provide a mechanical interlock with the groove 20. Some lug profiles may provide easier assembly or some other advantage.

For people wishing to produce their own bullets, it is not necessary to obtain much of the quite expensive tooling normally associated with custom manufacture. Further, once the initial tooling is obtained, the ongoing cost per projectile is also less for the present invention compared to the traditional construction.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A projectile for use in a rifled gun barrel comprising:

a slug having a nose section at one end, a driving band circumferentially about the nose section and a shank section at an opposite end;

a jacket of plastics material, being a generally hollow smooth outer walled cylinder with a closed base encasing the shank section of the slug; and fixing means securing the slug and jacket combination together sufficiently strongly to maintain the combination together during firing and subsequent flight of the projectile and wherein in combination the driving band and jacket have dimensions in relation to a pre-selected nominal rifled gun bore so that when fired along said bore the driving band and jacket engage the rifling to spin the projectile.

2. A projectile as defined in claim 1 wherein the fixing means is an interference fit between said jacket and said shank section.

3. A projectile as defined in claim 2 wherein the fixing means further includes use of an adhesive between the inside of said jacket and the outside of said shank section.

4. A projectile as defined in claim 2 wherein the fixing means further includes mechanically interlocking parts being cooperative and respectively part of the inside of said jacket and the outside of said shank section.

5. A projectile as defined in claim 4 wherein said mechanically interlocking parts are lugs being part of the inside of said jacket and grooves being part of the outside of said shank section, said lugs being sized to fit closely within said grooves.

6. A projectile comprising:

a slug having a nose section at one end and a shank section at an opposite end;

a jacket of plastics material, being a generally hollow cylinder with a closed base encasing the shank section of the slug and sized so as to correspond to a pre-selected nominal gun bore; and fixing means securing the slug and jacket combination together sufficiently strongly to maintain the combination together during firing and subsequent flight of the projectile and wherein the fixing means is an interference fit between said jacket and said shank section and wherein the closed end of said jacket includes a central air vent therethrough.

7. A projectile as defined in claim 6 wherein the outer diameter of said jacket and said slug are sized to correspond to a pre-selected gun bore.

8. A kit of parts for a projectile for use in a rifled gun bore comprising:

a slug having a nose section at one end, a driving band defining the outer dimension of the nose section and a shank section at an opposite end; and a jacket of plastics material, being a generally hollow smooth outer walled cylinder with a closed base and being dimensioned such that the shank section can be inserted into the hollow of the jacket and secured therein by a fixing means so as to form a projectile with the outer dimension of the assembled nose section and the jacket sized so as to correspond to a pre-selected nominal rifled gun bore so that when fired along said bore both the driving band and jacket will engage the rifling to spin the projectile.

9. A projectile for use in a rifled gun barrel comprising:

a slug having a nose section at one end, a driving band formed circumferentially about the nose section and a shank section at an opposite end;

a jacket of plastics material, being a generally hollow smooth outer walled cylinder with a closed base encasing the shank section of the slug; and fixing means securing the slug wherein the outside dimension of said jacket forms an interference fit therebetween and the inside of the jacket includes a lug extending radially inwardly engaging a cooperative annular groove within the shank section and with the inside closed end of the jacket pushed up squarely against the end of the shank section so as to maintain the combination together during firing and subsequent flight of the projectile and wherein the driving band and jacket have dimensions in relation to a pre-selected nominal rifled gun bore so that when fired along said bore the driving band and jacket engage the rifling to spin the projectile.

10. A projectile as in claim 9 wherein the slug and the jacket combination includes an outer leading edge of the jacket spaced axially from a rear face of the nose section of the slug.

* * * * *